US007179061B2

(12) United States Patent
Horton et al.

(10) Patent No.: US 7,179,061 B2
(45) Date of Patent: Feb. 20, 2007

(54) MULTI-LAYER COMPRESSOR HOUSING AND METHOD OF MANUFACTURE

(75) Inventors: William Travis Horton, Manchester, MI (US); Robert D. Mowatt, Pinckney, MI (US)

(73) Assignee: Tecumseh Products Company, Tecumseh, MI (US)

( * ) Notice: Subject to any disclaimer, the term of this patent is extended or adjusted under 35 U.S.C. 154(b) by 392 days.

(21) Appl. No.: 10/457,203

(22) Filed: Jun. 9, 2003

(65) Prior Publication Data

US 2004/0247472 A1 Dec. 9, 2004

(51) Int. Cl.
*F04B 49/00* (2006.01)
*F04B 17/00* (2006.01)

(52) U.S. Cl. ..... 417/220; 417/415; 417/902

(58) Field of Classification Search ..... 417/415, 417/902, 220, 53

See application file for complete search history.

(56) References Cited

U.S. PATENT DOCUMENTS

| | | | | |
|---|---|---|---|---|
| 2,059,894 A | | 11/1936 | Newman | 230/30 |
| 2,246,868 A | | 6/1941 | Trask | 230/206 |
| 3,229,901 A | | 1/1966 | Parker | 230/206 |
| 3,871,313 A | * | 3/1975 | Yamauchi | 29/505 |
| 4,049,410 A | * | 9/1977 | Miller | 62/197 |
| 4,671,831 A | * | 6/1987 | Mohan | 156/69 |
| 5,013,221 A | | 5/1991 | Tuckey | 417/365 |
| 5,326,231 A | * | 7/1994 | Pandeya et al. | 417/271 |
| 5,419,139 A | * | 5/1995 | Blum et al. | 62/45.1 |
| 5,518,141 A | * | 5/1996 | Newhouse et al. | 220/586 |
| 5,997,258 A | * | 12/1999 | Sawyer et al. | 417/312 |
| 6,190,137 B1 | | 2/2001 | Robbins et al. | 417/221 |
| 6,872,057 B2 | * | 3/2005 | Kim | 417/312 |

* cited by examiner

*Primary Examiner*—Anthony D. Stashick
*Assistant Examiner*—Ryan Gillan
(74) *Attorney, Agent, or Firm*—Baker & Daniels LLP

(57) ABSTRACT

A multi-layered compressor housing and method of manufacture is provided. The housing defines an interior space and includes first and second layers having first and second major surfaces respectivley. The first and second layers are secured together by the frictional engagement of the first and second major surfaces which each substantially enclose the interior space defined by the housing. The housing may be manufactured by placing first and second layers of sheet stock material in mutual facing engagement wherein the two layers are relatively moveable. The first and second relatively moveable layers are then simultaneously formed into a non-planar shape defining at least a portion of the housing. A compressor is then mounted in the housing and the housing is hermetically sealed. The simultaneous forming of the first and second layers into a non-planar shape causes the frictional engagement of the layers whereby the layers are secured together.

27 Claims, 3 Drawing Sheets

MULTI-LAYER COMPRESSOR HOUSING AND METHOD OF MANUFACTURE

BACKGROUND OF THE INVENTION

1. Field of the Invention

The present invention relates to compressor housings and, more specifically, to hermetically sealed compressor housings having two or more walls and a method of manufacturing such compressor housings.

2. Description of the Related Art

The use of hermetically sealed housings for compressors is well known in the art and may be used with a variety of different types of compressor mechanisms including scroll compressors, reciprocating compressors and rotary compressors. The fluid filling the interior volume of such hermetically sealed housings, such as a refrigerant vapor, may be at the suction pressure at which fluids enter the compressor housing or at the discharge pressure at which fluids are discharged from the compressor mechanism. The housing may also be partitioned into multiple separate chambers that contain fluids at different pressures. For example, the housing may have one such chamber that contains fluids at the suction pressure and another such chamber contains fluids at the discharge pressure.

Such hermetically sealed housings typically consist of a single sheet of material, such as a low carbon steel material, which is formed into a desired shape by a stamping or hydroforming process. In conventional compressor assemblies, such as those used in refrigeration systems, the refrigerant compressed within the housing may have a discharge pressure in the range of 250 to 300 psi (pounds per square inch). Some refrigerants, however, require higher pressures. For example, refrigerant systems utilizing $CO_2$ as the refrigerant may have discharge pressures which reach 2200 psi. The hermetically sealed housings used with refrigerants that require a higher operating pressure must, of course, be able to withstand the higher pressures associated therewith.

One method of providing a housing that may withstand relatively high pressures is to increase the thickness of the housing walls. This method, however, can become relatively expensive because the required thickness of the walls may exceed the thickness of commonly available draw quality steel thereby requiring the special ordering, and the enhanced expenses associated therewith, of an appropriate thickness of draw quality steel.

A cost effective method of producing an hermetically sealed housing capable of withstanding relatively high pressures is desirable.

SUMMARY OF THE INVENTION

The present invention provides a housing that may be cost effectively manufactured and which may also be used with relatively high pressure compressor assemblies.

The invention comprises, in one form thereof, a compressor housing assembly which includes a housing defining an hermetically sealed interior space. The housing includes a first layer having a first major surface and a second layer having a second major surface wherein the first and second major surfaces are disposed in mutual facing engagement. The first and second layers are secured together by frictional engagement of the first and second major surfaces and the first and second major surfaces each substantially enclose the interior space. A compressor mechanism is disposed within the housing.

The first and second major surfaces of such an assembly may have substantially similar surface areas and substantially all of the first and second major surfaces may be in mutual engagement. The assembly may also include a fitting wherein the housing defines a first opening extending through said first and second layers and the fitting is positioned in the first opening and sealingly engaged with each of the first and second layers. The fitting may be welded to each of the first and second layers.

The housing may include first and second section wherein each of the first and second sections include a first layer having a first major surface and a second layer having a second major surface wherein the first and second major surfaces are disposed in mutual facing engagement and the first and second layers are secured together by frictional engagement of the first and second major surfaces with the first and second sections being joined together. The first and second sections of the housing may be joined together by a weld wherein each of the first layers and each of the second layers are joined by the weld.

The first and second layers of the housing may be formed of a common material, or, of different materials. The first and second layers of the housing may have a common thickness, or, the layers may have unequal thicknesses. In some embodiments, the first and second layers are formed of a common material and have a common thickness.

The compressor housing may also include a first layer that has a directionally variable material property wherein the first layer is positioned at a predetermined orientation relative to the second layer with respect to the directionally variable material property. In other embodiments, each of the first and second layers has a directionally variable material property and the first and second layers are relatively positioned at a predetermined orientation with respect to the directionally variable material property. For example, the first and second layers may each be formed out of a carbon steel material having a grain orientation and the grain orientations may be positioned at a predetermined angle.

The securement of the first layer to the second layer may consist essentially of frictional engagement the first and second major surfaces. The housing may also include a third layer having a third major surface wherein the third major surface frictionally engages one of the first and second layers and substantially encloses the interior space.

The invention comprises, in another form thereof, a compressor housing assembly including a housing defining a hermetically sealed interior space. The housing includes a plurality of adjacently disposed and substantially coextensive layers wherein each of the layers are secured to an adjacent layer. Securement of the adjacent layers consists essentially of frictional engagement between the adjacent layers. A compressor mechanism is disposed within the housing.

The invention comprises, in yet another form thereof, a method of manufacturing a compressor. The method includes placing a first layer of sheet stock material and a second layer of sheet stock material in mutual facing engagement wherein the first and second layers are relatively moveable; simultaneously forming the relatively moveable first and second layers into a non-planar shape defining at least a portion of a housing; mounting a compressor mechanism within the housing; and hermetically sealing the housing.

The step of simultaneously forming the relatively moveable first and second layers into a non-planar shape may include hydroforming the first and second layers. The method may also include the step of temporarily securing the first and second layers together after the step of placing the first and second layers in mutual facing engagement. The step of simultaneously forming the relatively moveable first and second layers into a non-planar shape may also include securing the first and second layers together by frictional engagement of the first and second layers.

The method may also include forming a beveled opening extending through the first and second layers and securing a fitting in the opening wherein the fitting is sealingly engaged with each of the first and second layers. The fitting may be secured by welding the fitting to the first layer and the second layer.

The step of hermetically sealing the housing may include joining a first housing section to a second housing section wherein each of the housing sections are formed by the steps of: a) placing a first layer of sheet stock material and a second layer of sheet stock material in mutual facing engagement wherein the first and second layers are relatively moveable; and b) simultaneously forming the relatively moveable first and second layers into a non-planar shape. The method may also include beveling an edge of each of the first and second housing sections and joining the first and second housing sections along the beveled edges wherein each of the first and second layers of each of the first and second housing sections are joined.

An advantage of the present invention is that by utilizing two separate sheet material layers to form the housing of a compressor assembly, the invention provides a housing that can be used with relatively high pressures and still utilize commonly available sheet material thereby facilitating the cost efficient manufacture of the housing.

Another advantage of the present invention is that by providing two layers of material to form the housing wherein the two layers of material are secured together using frictional engagement, the housing inhibits the transmission of acoustic energy from within the housing to the external environment.

BRIEF DESCRIPTION OF THE DRAWINGS

The above mentioned and other features and objects of this invention, and the manner of attaining them, will become more apparent and the invention itself will be better understood by reference to the following description of the invention taken in conjunction with the accompanying drawings, wherein.

Figure 1:
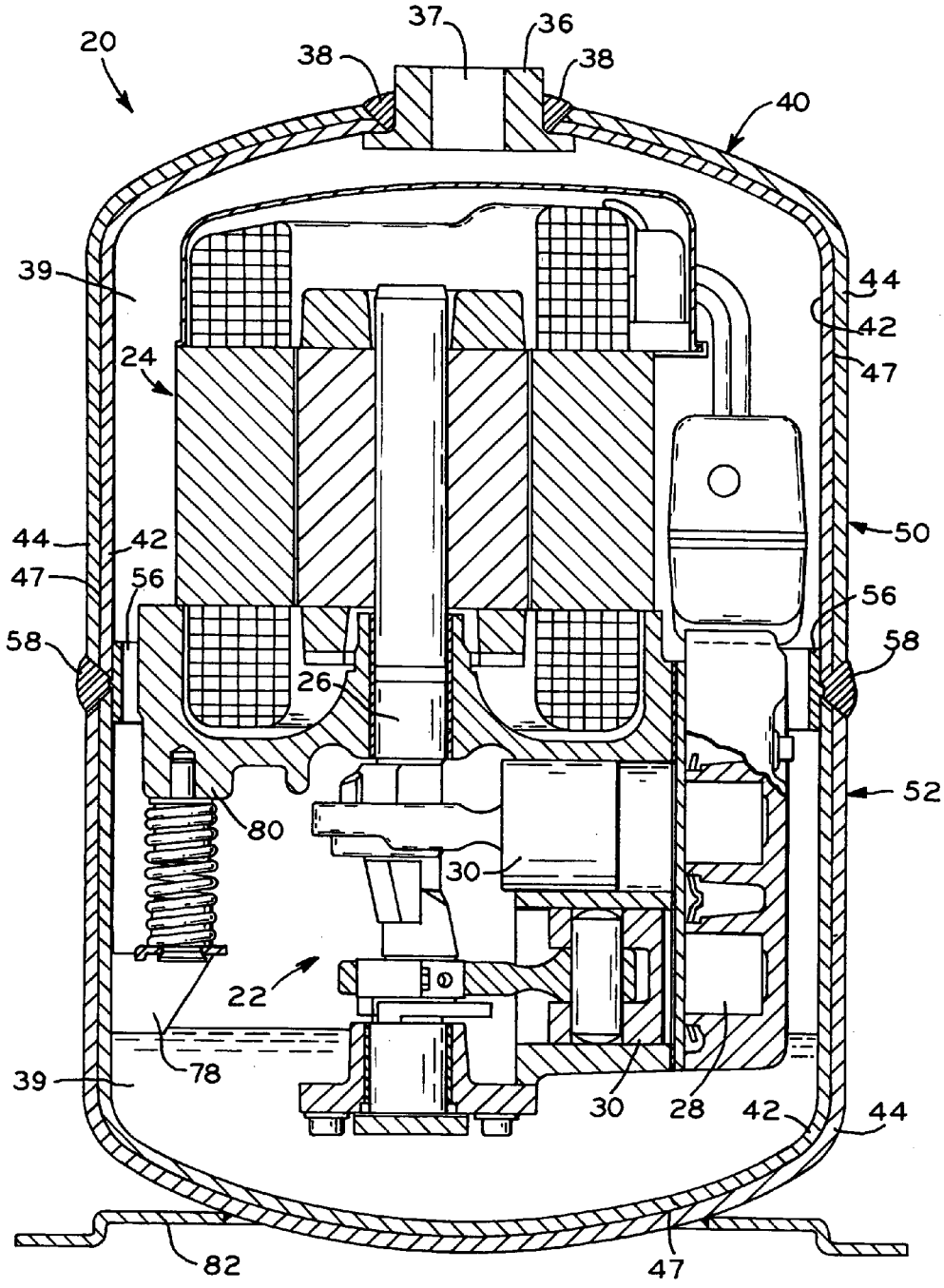
FIG. 1 is a cross sectional view of a compressor assembly taken along line 1—1 of FIG. 2.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise forms disclosed. It is further noted that the use of the terms "first" and "second" and the like, do not, by themselves, imply any structural relationship of the part or item so labeled.

DESCRIPTION OF THE PRESENT INVENTION

In accordance with the present invention, a compressor housing assembly 20 is shown in FIG. 1. Assembly 20 includes a compressor mechanism 22 operably coupled to electric motor 24 by crankshaft 26. In the illustrated embodiment, compressor mechanism 22 is a reciprocating compressor, however, the present invention may also be utilized with other types of compressor mechanisms such as scroll and rotary compressor mechanisms. Compressor mechanism 22 includes a discharge chamber 28 which receives refrigerant vapors compressed by the reciprocating pistons 30 of compressor mechanism 22. An example of a reciprocating compressor mechanism that may be used with the present invention is described in U.S. Pat. No. 6,190,137 B1, assigned to the assignee of the present invention, the disclosure of which is hereby incorporated herein by reference.

As can be seen in FIG. 1, housing 40 is formed by an inner layer 42 and an outer layer 44. Housing 40 includes first and second housing sections 50, 52 and is discussed in greater detail below. The interior volume 39 of housing 40 in which motor 24 and compressor mechanism 22 are located generally defines a suction chamber wherein refrigerant vapors are at suction pressure during operation of the compressor. When the compressor is shutdown, the pressure within the interior volume 39 rises as the pressure throughout the vapor compression system equalizes. Although not shown, an oil sump may be located within the interior volume 39 at the lower end thereof. In alternative embodiments of the present invention, the interior volume 39 of housing 40 may be at discharge pressure or partitioned into multiple chambers which are at different pressures.

In the illustrated embodiment, three fittings 32, 34 and 36 penetrate housing 40. Fitting 32 is located in housing section 52 and defines the discharge outlet for the compressor assembly 20. Discharge chamber 28 is in fluid communication with fitting 32 and a conduit (not shown), such as a copper tube, may be at least partially inserted into fitting 32 and joined thereto by welding, brazing or the like to thereby form the discharge line. Fitting 34 is located above fitting 32 and defines the suction inlet. A suction line (not shown), that may take the form of a copper tube, is joined to fitting 32 by welding, brazing or the like. In the illustrated embodiment, the interior opening of fitting 32 is in communication with interior volume 39 of housing 40. Fitting 36 is shown located at the top of compressor assembly 20 and defines a passageway 37 through which electrical connections are made to provide electrical power to motor 24.

Layers 42, 44 which form housing 40 respectively define major surfaces 46, 48 (FIG. 7) which are placed in mutual facing contact. When inner and outer layers 42, 44 are formed into their desired shape, major surfaces 46, 48 are frictionally engaged with each other and define frictional interface 47 whereby adjacent layers 42, 44 are joined together as discussed in greater detail below. In the disclosed embodiment, inner and outer layers 42, 44 are each a 3/16 inch thickness sheet of 10 08 low carbon steel. To provide housing 40 with more uniform strength properties, the grain orientation of the inner and outer layers 42, 44 are oriented at a substantially perpendicular orientation.

Alternative embodiments of housing 40, however, could utilize layers having different materials or thicknesses. For example, the two separate layers could be formed of the same material and have different thicknesses. By utilizing two different thicknesses and/or different materials it would be possible to impart different resonant properties to the different layers and thereby enhance the dampening effect of the housing layers on the transmission of acoustic energy therethrough. The use of two layers formed out of different materials may also provide additional advantages. For example, if it was desirable for the interior surface of the housing to have different material properties than the exterior surface of the housing, the use of different materials to form the two layers would facilitate the provision of such different material properties.

Figure 10:
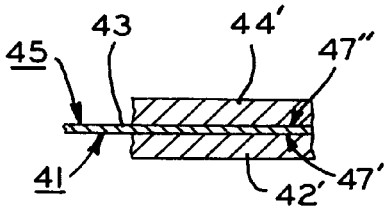
FIG. 10 is a partial sectional view of an alternative housing having three layers.

Additionally, it is also possible for the housing to be formed out of more than two layers of sheet material. For example, it may be desirable for a high temperature viscoelastic membrane to be positioned between two low carbon steel layers. It is thought that such an intermediate layer of high temperature polymeric materials could further dampen the transmission of acoustic energy through the housing. FIG. 10 provides a schematic cross sectional view of such a three layer housing. In such a housing, three substantially coextensive layers, inner layer 42', middle layer 43 and outer layer 44' are each in frictional engagement with an adjacently disposed layer. Middle layer 43 extends outwardly from layers 42' and 44' solely to facilitate the clarity of FIG. 10. More specifically, middle layer 43 includes two oppositely disposed major surfaces 41, 45 that are in frictional engagement with major surfaces of layers 42' and 44' respectively and define frictional interfaces 47' and 47" respectively.

To form housing 40, first and second housing sections 50, 52 are joined together. In the illustrated embodiment, housing sections 50, 52 are joined by welding. To avoid weld splatter within housing 40, a circular backing ring 56 is positioned in contact with the radially inward facing surfaces of first and second housing sections 50, 52 and spanning the gap between housing sections 50, 52 for the full circumference of housing sections 50, 52. Backing rings that may be used with the present invention are commercially available from Robvon Backing Ring Co. having a place of business at #1 Ring Road, Factoryville, Pa. 18419. The illustrated backing ring is a carbon steel ring and includes a spacing ridge 57 positioned between and spacing housing sections 50, 52. Other backing rings, however, having a generally flat radially outer surface or other configuration or manufactured out of other materials may also be used to facilitate the joining of housing sections 50, 52. It would also be possible for housing sections 50, 52 to be directly welded together without the use of a backing ring or joined in another suitable manner.

Figure 2:
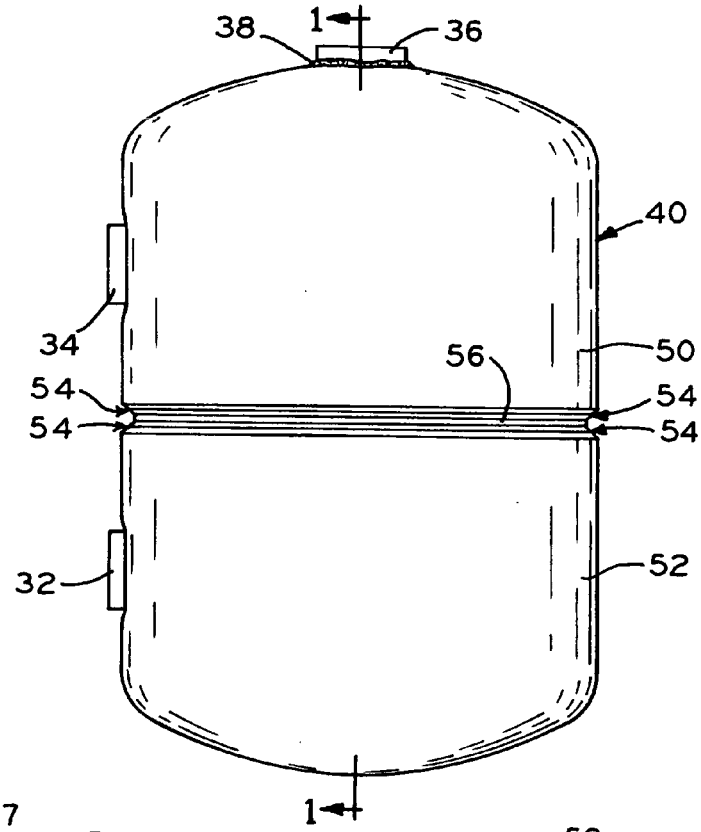
FIG. 2 is a side view of a compressor assembly prior to joining the two housing sections together.
Figure 3:
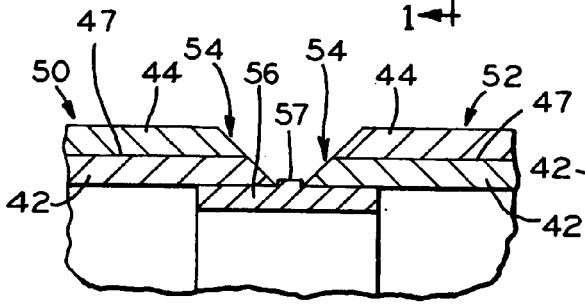
FIG. 3 is a detail view of the joint between the two housing sections before the sections are joined.
Figure 4:
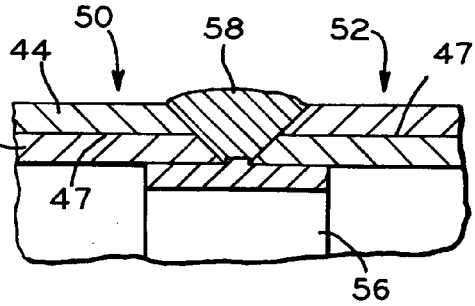
FIG. 4 is a detail view of the joint between the two housing sections after the sections have been joined by a weld.

As best illustrated in FIGS. 3 and 4, a bevel 54 is provided at the edge of housing sections 50, 52 to provide greater access to radially inwardly disposed interior layer 42 when joining housing sections 50, 52. FIGS. 2 and 3 illustrate housing compressor assembly 20 after backing ring 56 has been positioned to engage each of housing sections 50, 52 and before welding housing sections 50, 52 together while FIG. 4 illustrates weld nugget 58 which is formed by a conventional welding process joining housing sections 50, 52 together. Welding processes for joining housings are well known to those having ordinary skill in the art. As can be seen in FIG. 4, weld 58 joins each of the interior layers 42 of housing sections 50, 52 together and also joins each of the outwardly disposed layers 44 of housing sections 50, 52 together. By joining each of the interior layers 42 together, the vapors present in the interior of housing 40 are prevented from entering the frictional interface 47 between layers 42, 44 and both layers 42 and 44 act together to thereby form a pressure vessel confining the vapors within interior volume or space 39. In the illustrated embodiment, bevels 54 form an approximately 45 degree angle with major surfaces of layers 42, 44. In alternative embodiments, however, other angles may be used to form bevels 54 or housing sections 50, 52 may be joined without using a bevel 54.

Figure 5:
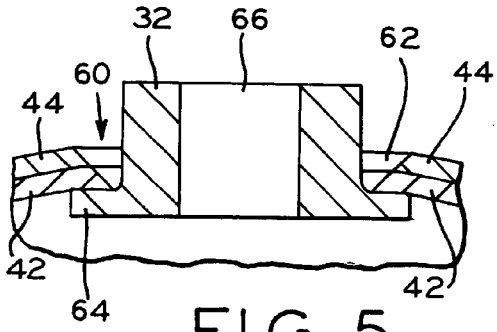
FIG. 5 is a detail view of a fitting positioned in an opening of the housing.
Figure 6:
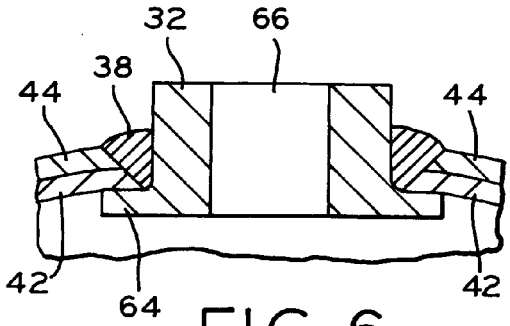
FIG. 6 is a detail view of a fitting after it has been welded to the housing.

FIGS. 5 and 6 illustrate in greater detail the securement of a fitting to housing 40. An opening 60 is formed through both layers 42, 44 of housing 40 to receive fitting 32 and the edges of opening 60 form bevel 62 to facilitate the joining of radially inwardly disposed layer 42. In the illustrated embodiment bevel 62 forms a 45 degree angle with major surfaces 46, 48 of layers 42, 44 but other angles may also be used to form such a bevel. Fitting 32 is inserted through opening 60 from the interior of housing 40 before joining the two housing sections 50, 52 together and has a flange 64 that extends radially outwardly from the cylindrical shank of fitting 32 and thereby forms a backing member about opening 60. Passageway 66 extends through fitting 32 and a copper tube (not shown) may be positioned at least partially within fitting 32 and then joined to fitting 32 by welding, brazing or the like.

FIG. 5 is a detail view illustrating fitting 32 after it has been inserted through opening 60 but before welding fitting 32 therein. FIG. 6 illustrates fitting 32 and housing 40 after fitting 32 has been welded thereto. As can be seen in FIG. 6, both of layers 42, 44 are joined to fitting 32 by weld 38 to thereby sealingly engage fitting 32 with both of the layers forming housing 40. By sealingly engaging both layers 42, 44 to fitting 32, the frictional interface 47 is sealed off from the vapors within interior volume 39 and thereby prevents the outer layer 44 from having to resist the full pressure of the vapor within volume 39 by itself. Although advantageous, a bevel 62 is not essential to installing a fitting in housing 40 which is sealingly engaged with each of the layers of housing 40. In alternative embodiments, fittings may also be joined to housing 40 using alternative methods, such as adhesives, which sealingly engage the fittings to the housing, including the most radially inwardly disposed layer.

Figure 7:
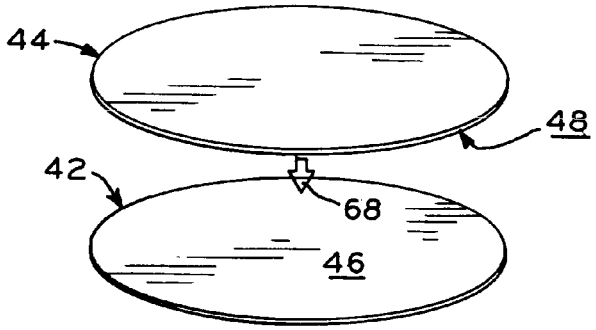
FIG. 7 is a schematic view of two housing layers being positioned in mutual facing contact.
Figure 8:
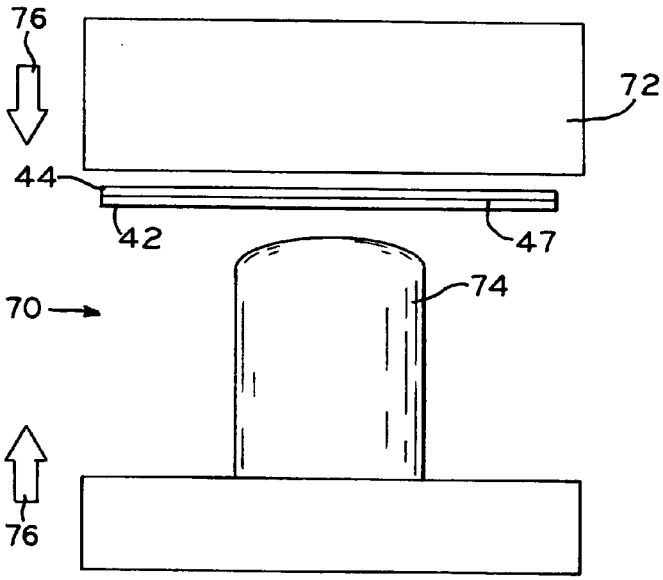
FIG. 8 is a schematic view of two housing layers positioned in a hydroforming die.

The forming of housing 40 and assembly of compressor 20 will now be described with reference to FIGS. 7–9. To form illustrated housing 40, first and second housing sections 50, 52 are separately formed and then joined together after mounting compressor mechanism 22 and motor 24 within the housing. More specifically, inner and outer layers 42 and 44 are cut from sheet stock material into a shape appropriate to form housing sections 50, 52, which, in the illustrated embodiment is substantially circular. Layers 42, 44 are then stacked one on top of the other as indicated by arrow 68 in FIG. 7 whereby major surfaces 46, 48 are placed in mutual facing engagement. The layers are not joined together prior to forming and are still moveable relative to each other before being simultaneously formed into their final shape. It may, however, be desirable to temporarily join layers 42, 44 together to facilitate their handling prior to forming layers 42, 44 into their final shape. Such temporary joining of the layers could take many forms and includes the use of adhesives or spot welding. Such temporary joining would need to be sufficient to retain first and second layers 42, 44 in their desired relative orientation during handling but would not be required to be sufficient to form the permanent bond between the two layers to hold the layers in their final shape. It is also advantageous to limit the surface area where the separate layers are bonded together and thereby limit the potential for transmitting acoustic energy between layers at such bonds. In the disclosed embodiment, the locations of such inter-layer bonds occur only at the seam between the two housing sections 50, 52 and at the location of the fittings 32, 34, 36, i.e., such inter-layer bonds are only present at the edges or discontinuities of the layers.

It may be advantageous to temporarily join layers 42, 44 together when one or both of the layers has a directionally variable material property and it is desirable to position the directionally variable property at a predetermined angle or orientation relative to the other layer. For example, low carbon steel typically has a grain orientation and the strength of the steel is subject to variation dependent upon the grain orientation. By positioning two layers of low carbon steel to form a perpendicular angle between the directions of their grain orientations, the combination of the two layers will have a more homogenous strength profile. Where only one of the layers has a directionally variable material property, it may still be advantageous to orient the layers at a predetermined angle or orientation, particularly if the shape of the sheet material layers or final shape of the housing section formed thereby is non-symmetrical.

After positioning layers 42, 44 into mutual facing contact, the assembled layers 42, 44 are positioned in hydroforming assembly 70. Hydroforming assembly 70 includes an upper water bladder 72 and a lower die 74. Lower die 74 has a cylindrical projection which matches the shape of the desired interior volume of housing sections 50, 52. Directional arrows 76 indicate the relative movement of upper and lower dies 72, 74 as layers 42, 44 are formed into their desired shape in a conventional hydroforming process. Instead of using a hydroforming process, layers 42, 44 may alternatively be formed by a stamping process using a conventional press machine.

The simultaneous forming of layers 42, 44 into the non-planar shape of housing sections 50, 52 creates a frictional engagement between major surfaces 46, 48. The frictional engagement of surfaces 46, 47, i.e., frictional interface 47, is sufficient to secure layers 42, 44 together and forms the primary bond between layers 42, 44 after final assembly of housing 40. Although welds 38, 58 provide some bonding between layers 42, 44, in the illustrated embodiment, frictional interface 47 is sufficient by itself to secure layers 42, 44 together and forms the primary means by which the layers 42, 44 are secured together. In other words, the securement of layers 42 and 44 together consists essentially of the frictional engagement of major surfaces 46 and 48.

Figure 9:
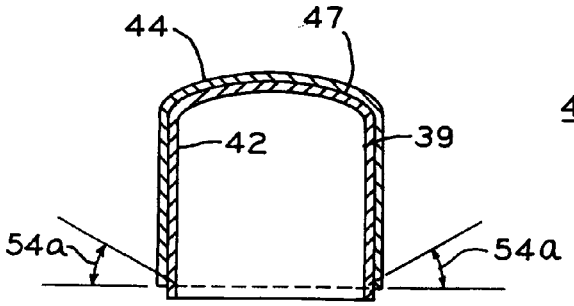
FIG. 9 is a cross sectional view of a housing section after being formed by the die of FIG. 8.

FIG. 9 illustrates layers 42, 44 after they have been hydroformed. As can be seen in FIG. 9, layers 42, 44 are engaged along frictional interface 47 for substantially all of the surface area of major surfaces 46, 48. The frictional interface 47 between surfaces 46, 48 extends in a substantially enclosing manner around the interior volume 39 which is defined by layers 42, 44. By using two pieces of identical sheet stock material, interior layer 42 projects slightly outwardly relative to exterior layer 44 at the open end of the housing section formed by layers 42, 44. As indicated by the dashed lines shown in FIG. 9, a bevel cut disposed at angle 54*a* is used to trim the open end of the housing section formed by layers 42, 44 and thereby form bevel 54. Appropriate beveled openings are then cut into the housing section to provide for the mounting of fittings therein as described above.

After forming housing sections 50, 52 and mounting fittings 32, 34, 36 therein, compressor mechanism 22 and motor 24 are mounted therein. In the illustrated embodiment, bracket 78 is welded to the interior of housing 40 to provide support for main bearing support 80 of the compressor 22 and motor 24 assembly to thereby mount compressor 22 and motor 24 to lower housing section 52 prior to joining housing sections 50 and 52 together. In the illustrated embodiment, a mounting member 82 is tack welded to exterior layer 44 to support the compressor assembly in a vertically oriented position.

Alternative methods of mounting the compressor 22 and motor 24 assembly within housing 40 may also be employed with the present invention. For example, the compressor 22 and motor 24 assembly could be press fit or heat-shrink fitted within housing 40. After compressor mechanism 22 and motor 24 have been mounted within housing section 52, the compressor 22 and motor 24 assembly is hermetically sealed within housing 40 by joining housing section 50 to housing section 52. Although fittings 32, 34, 36 may still define unsealed passageways 66 when housing sections 50, 52 are hermetically joined together, after completing manufacture of compressor assembly 20 and installing the compressor, such passageways will no longer permit the unintended passage of vapor between the interior and exterior of housing 40. In alternative embodiments, a single layered closure member welded, or otherwise joined, to the open end of a multi-layered housing section to hermetically seal the multi-layered housing section with a compressor mechanism mounted therein.

While this invention has been described as having an exemplary design, the present invention may be further modified within the spirit and scope of this disclosure. This application is therefore intended to cover any variations, uses, or adaptations of the invention using its general principles.

What is claimed is:

1. A compressor assembly comprising:

a housing defining an hermetically sealed interior space, said housing comprising a first substantially solid metal layer having a first major surface and a second substantially solid metal layer having a second major surface, said first and second major surfaces having substantially similar surface areas, said first and second major surfaces disposed in mutual facing engagement, wherein substantially all of said first and second major surfaces are mutual engaged, said first and second substantially solid metal layers secured together by direct frictional engagement of said first and second major surfaces, said first and second major surfaces forming sidewalls and end walls, said sidewalls integral with said end walls, said sidewalls and said end walls cooperating to substantially enclose said interior space; and a compressor mechanism disposed within said housing.

2. The compressor assembly of claim 1 wherein said housing includes a first section and a second section, each of said first and second sections comprising a substantially solid first metal layer having a first major surface and a substantially solid second metal layer having a second major surface, said first and second major surfaces disposed in mutual facing engagement and said first and second layers secured together by direct frictional engagement of said first and second major surfaces, said first and second sections being joined together.

3. The compressor of claim 2 further comprising a heat weld joining said first and second sections together wherein each of said first layers and each of said second layers are joined by said heat weld.

4. The compressor assembly of claim 1 further comprising a fitting and wherein said housing defines a first opening extending through said first and second layers; said fitting positioned in said first opening and sealingly engaged with each of said first and second layers.

5. The compressor of claim 4 wherein said fitting is heat welded to each of said first and second layers.

6. The compressor assembly of claim 1 wherein each of said first and second layers are formed of a common metal.

7. The compressor assembly of claim 1 wherein said first and second layers are formed of different metals.

8. The compressor assembly of claim 1 wherein said first and second layers have a common thickness.

9. The compressor assembly of claim 1 wherein said first and second layers have unequal thicknesses.

10. The compressor assembly of claim 1 wherein each of said first and second layers are formed of a common metal and have a common thickness.

11. The compressor assembly of claim 1 wherein said first layer has a directionally variable material property and said first layer is positioned at a substantially perpendicular angle relative to said second layer with respect to said directionally variable material property.

12. The compressor assembly of claim 1 wherein each of said first and second layers has a directionally variable material property and said first and second layers are relatively positioned at a substantially perpendicular angle with respect to said directionally variable material property.

13. The compressor assembly of claim 1 wherein said first and second layers are each a carbon steel material having a grain orientation and said grain orientations are positioned at a substantially perpendicular angle relative to one another.

14. The compressor assembly of claim 1 wherein securement of said first layer to said second layer consists essentially of direct frictional engagement of said first and second major surfaces.

15. A compressor assembly comprising:

a housing defining a hermetically sealed interior space, said housing including a plurality of adjacently disposed, substantially coextensive, and substantially solid metal layers, each of said layers secured to substantially all of an adjacent layer, the securement of said adjacent layers consisting essentially of direct frictional engagement between said adjacent layers, each of said layers forming sidewalls and end walls, said sidewalls integral with said end walls; and a compressor mechanism disposed within said housing.

16. The compressor assembly of claim 15 wherein said housing includes a first section and a second section, said first and second sections joined together, each of said first and second sections including a plurality of adjacently disposed, substantially coextensive, and substantially solid metal layers, each of said layers secured to an adjacent layer, securement of said adjacent layers consisting essentially of direct frictional engagement between said adjacent layers.

17. The compressor assembly of claim 16 comprising a heat weld joining said first and second sections together wherein each of said layers of each of said first and second sections are joined by said heat weld.

18. The compressor assembly of claim 15 further comprising a fitting and wherein said housing defines a first opening extending through said plurality of layers; said fitting positioned in said first opening and sealingly engaged with each of said plurality of layers.

19. The compressor of claim 18 wherein said fitting is heat welded to each of said plurality of layers.

20. A method of manufacturing a compressor, said method comprising:

placing a first layer of planar sheet stock material and a second layer of planar sheet stock material in mutual facing engagement wherein said first and second layers are relatively moveable;

simultaneously forming said relatively moveable first and second layers into a non-planar shape having a sidewall integral with an end wall and defining at least a portion of a housing;

mounting a compressor mechanism within said housing; and hermetically sealing said housing.

21. The method of claim 20 further comprising the step of temporarily securing said first and second layers together after said step of placing said first and second layers in mutual facing engagement.

22. The method of claim 20 wherein said step of simultaneously forming said relatively moveable first and second layers into a non-planar shape further comprises securing said first and second layers together by direct frictional engagement of said first and second layers.

23. The method of claim 20 further comprising:

forming a beveled opening extending through said first and second layers; and securing a fitting in said opening wherein said fitting is sealingly engaged with each of said first and second layers.

24. The method of claim 23 wherein securing said fitting in said opening comprises heat welding said fitting to said first layer and said second layer.

25. The method of claim 20 wherein said step of hermetically sealing said housing comprises joining a first housing section to a second housing section, each of said housing sections being formed by the steps of:

a) placing a first layer of planar sheet stock material and a second layer of planar sheet stock material in mutual facing engagement wherein said first and second layers are relatively moveable;

b) simultaneously forming said relatively moveable first and second layers into a non-planar shape.

26. The method of claim 25 further comprising:

beveling an edge of each of said first and second housing sections; and joining said first and second housing sections along said beveled edges wherein each of said first and second layers of each of said first and second housing sections are joined.

27. The method of claim 20 wherein said step of simultaneously forming said relatively moveable first and second layers into a non-planar shape comprises hydroforming said first and second layers.

* * * * *